US005083678A

United States Patent [19]

Waring

[11] Patent Number: 5,083,678

[45] Date of Patent: Jan. 28, 1992

[54] COLLAPSIBLE DISPENSER BOTTLE

[75] Inventor: Donald A. Waring, Yorba Linda, Calif.

[73] Assignee: James River Corporation, Oakland, Calif.

[21] Appl. No.: 573,472

[22] Filed: Aug. 27, 1990

[51] Int. Cl.[5] ..... B65D 37/00

[52] U.S. Cl. ..... 222/92; 222/105

[58] Field of Search ..... 222/94, 105, 107, 181, 222/92, 185; 220/465; 215/11.3

[56] References Cited

U.S. PATENT DOCUMENTS

| | | | |
|---|---|---|---|
| 3,081,002 | 3/1963 | Tauschinski et al. | 222/107 X |
| 3,206,054 | 9/1965 | Militello | 215/11.3 |
| 3,467,283 | 9/1969 | Kinnavy | 222/95 |
| 3,499,578 | 3/1970 | O'Neal | 222/161 X |
| 3,911,918 | 10/1975 | Turner | 222/94 X |
| 3,921,630 | 11/1975 | McPhee | 222/107 X |
| 3,926,341 | 12/1975 | Lhoest | 222/95 |
| 4,090,541 | 5/1978 | Cammarata, III et al. | 222/107 X |
| 4,100,953 | 7/1978 | Miller | 222/107 X |
| 4,232,721 | 11/1980 | Martin et al. | 222/107 X |
| 4,308,904 | 1/1982 | Martin et al. | 222/107 X |
| 4,320,789 | 3/1982 | Martin et al. | 222/107 X |
| 4,331,266 | 5/1982 | Bond | 222/107 |
| 4,573,612 | 3/1986 | Maddison et al. | 222/181 X |
| 4,667,854 | 5/1987 | McDermott et al. | 222/181 X |
| 4,673,109 | 6/1987 | Cassia | 222/181 X |
| 4,700,871 | 10/1987 | Matsuo et al. | 222/107 |
| 4,805,788 | 2/1989 | Akiho | 215/1 C |
| 4,805,808 | 2/1990 | Larson | 222/185 |

*Primary Examiner*—Michael S. Huppert
*Assistant Examiner*—Anthoula Pomrening
*Attorney, Agent, or Firm*—Thomas R. Lampe

[57] ABSTRACT

A semi-rigid bottle of unitary molded construction and formed of thermoplastic material for dispensing liquid includes a bottom wall having an offset spout, a pair of collapsible primary walls, and a pair of auxiliary walls interconnecting the primary walls. One of the primary walls is located further from the spout than the other primary wall and collapses a greater distance than the other primary wall collapses during dispensing of the bottle contents. The primary walls engage above the spout when collapsed.

12 Claims, 3 Drawing Sheets

COLLAPSIBLE DISPENSER BOTTLE

TECHNICAL FIELD

This invention relates to a semi-rigid, collapsible bottle utilized to dispense the contents thereof. The bottle has particular application for use in a dispenser cabinet, for example, a liquid soap dispenser cabinet.

BACKGROUND ART

Collapsible dispenser bottles are well known in the art and range in complexity from a simple, thin walled plastic bag with a dispenser outlet to relatively complex arrangements specifically adapted for a particular use. The following patents disclose representative collapsible containers utilized to dispense liquids and other fluid materials: U.S. Pat. Nos. 4,805,808; 4,805,788; 4,700,871; 4,331,266; 4,100,953; 4,320,789; 3,962,341 and 3,467,283.

In common with prior art approaches, the bottle of the present invention is collapsible. However, the bottle is of a specific construction, incorporating features which cooperate in a novel manner to render the bottle particularly useful for use in dispenser cabinets for dispensing liquid soap, lotions and similar types of fluid products.

BRIEF SUMMARY OF THE INVENTION

In dispenser cabinets for liquid soaps, lotions and the like, it is usually advantageous to dispense the fluid product from a location at or near the front of the cabinet. Typically, soap and lotion cabinets utilize actuator structure engageable by the same hand receiving the soap or lotion to either open a valve or positively actuate a pump to initiate the dispensing.

The bottle of the present invention incorporates an offset dispenser spout which delivers the soap or other material to be dispensed to a forward cabinet location. The bottle is constructed so that it collapses in a controlled manner during dispensing in such a way as to encourage the complete dispensing of the container's content. More particularly, during dispensing, the walls gradually collapse in such a manner that they are generally positioned over the spout when the bottle approaches empty. That is, the container is so constructed that the rear wall, which is located a greater distance from the spout than is the front wall, will collapse a greater distance than the front wall collapses during dispensing so that both front and rear walls ultimately are disposed over the dispenser spout.

During the aforesaid collapse of the front and rear walls, a bottom wall of the bottle also distorts and changes shape in a controlled manner so as to further encourage complete dispensing of the bottle contents.

Another advantage of the structure of the bottle of the present invention is that the bottle may be utilized in conjunction with a dispensing cabinet incorporating a view hole for observing the level of the container contents. As will be described in greater detail below, the bottle wall facing toward the front of the container, i.e. toward the user, remains relatively closely adjacent to the front cabinet wall even when fully collapsed. Thus, if a view hole is located in the front cabinet wall the adjacent bottle wall will always remain in relatively close proximity thereto so that the bottle contents may be visually monitored (assuming, of course, that the bottle walls are either transparent or semi-transparent).

The bottle of the present invention is semi-rigid so that it may be positioned and employed in a dispenser cabinet without the need of special support structure in the cabinet. This is to be compared with plastic bags and the like which require auxiliary support not only during use but during transport, filling, and storage as well. Such support is often in the form of an external box within which the bag is disposed. By contrast, the bottle of the present invention is self supporting, strong, and configured for ease of handling.

The present bottle is of unitary molded construction and formed of thermoplastic material. The bottle is collapsible from a first configuration to a second configuration during the dispensing of the contents of the bottle.

The bottle includes first and second collapsible primary walls. First and second auxiliary walls are spaced from one another and interconnect the first and second primary walls, each of the auxiliary walls having a predetermined width less than the predetermined width of the primary walls.

A bottom wall interconnects the primary and auxiliary walls and includes a bottom wall portion. A top wall is connected to the primary and auxiliary walls and extends therebetween.

A spout defining a fluid flow-path leads from the bottle interior and projects outwardly from the bottom wall. The spout is located closer to the second primary wall than to the first primary wall. The bottom wall portion slopes downwardly from the first primary wall to the spout.

The first primary wall and the second primary wall are collapsible toward one another during dispensing of contents from the interior of the bottle to the spout flow-path. The first primary wall collapses a greater distance than the second primary wall collapses.

The bottom wall portion is flexible and changes shape from its initial configuration during dispensing of contents from the bottle interior through the spout flow-path. The spout flow-path has a central axis and the bottom wall portion defines a predetermined angle relative to the central axis prior to the change of shape of the bottom wall portion from its initial configuration. The bottom wall portion assumes an angle relative to said axis less than said predetermined angle during dispensing of the bottle contents and collapse of the first primary wall.

An auxiliary wall mold line extends along the length of each of the auxiliary walls from the top wall to the bottom wall, the wall thickness of the auxiliary walls increasing in the immediate vicinity of the auxiliary wall mold lines to strengthen the auxiliary walls and resist collapse thereof during dispensing of the contents of the bottle.

Other features, advantages, and objects of the present invention will become apparent with reference to the following detailed description and accompanying drawings.

BEST MODE FOR CARRYING OUT THE INVENTION

Figure 1B:
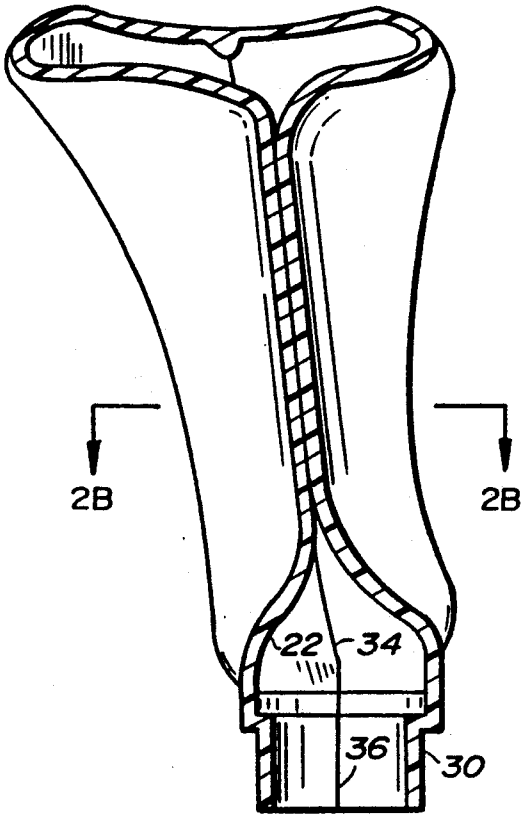
FIG. 1B is a view similar to FIG. 1A but illustrating the configuration of the bottle after the contents have been substantially completely dispensed therefrom.
Figure 1A:
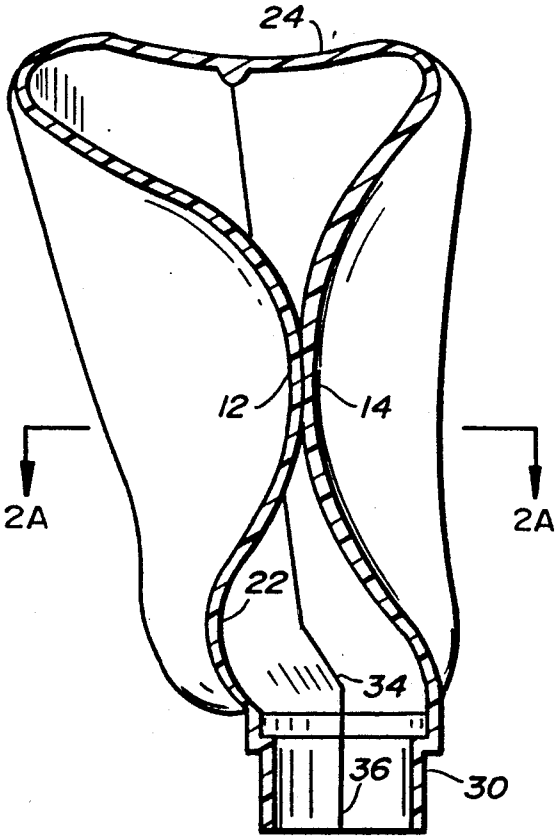
FIG. 1A is a cross-sectional, side elevation view of the bottle and illustrating the configuration assumed by the bottle after a portion of the contents of the bottle has been dispensed therefrom.

A preferred form of bottle constructed in accordance with the teachings of the present invention is generally identified in the drawing by reference numeral 10. Bottle 10 is semi-rigid and of unitary molded construction, said bottle being formed of a suitable thermoplastic material such as low density polyethylene. As will be seen in greater detail below, bottle 10 is collapsible from a first configuration to a second configuration during dispensing of the bottle, which may, for example, be liquid soap or lotion.

The interior of the bottle is defined by a plurality of walls of suitable thickness. Specifically, the bottle 10 includes a first collapsible primary wall 12 and a second collapsible primary wall 14. First and second auxiliary walls 16, 18, respectively, are spaced from one another and interconnect first and second primary walls 12, 14. Each of the auxiliary walls 16, 18 has a predetermined width less than the predetermined width of the primary walls.

A bottom wall 20 including wall portion 22 is interconnected to the primary and auxiliary walls. A top wall 24 is connected to the primary and auxiliary walls and extends therebetween. The top wall may be configured in any generally suitable fashion; however, the top wall 24 of the illustrated preferred embodiment of the molded bottle 10 defines a channel 26 which may be utilized in conjunction with a suitably configured dispensing cabinet to properly position a bottle therein. Such an arrangement will not be described in greater detail since in forms no part of the present invention. It will be appreciated that the top of the bottle 10 may be of any suitable configuration without departing from the scope of the present invention.

A spout 30 projects outwardly from bottom wall 20 and defines a fluid flow-path leading from the interior of the bottle. It will be noted that spout 30 is located closer to the second primary wall 14 than to the first primary wall 12. Bottom wall portion 22 slopes downwardly from first primary wall 12 to the spout 30.

Figure 3:
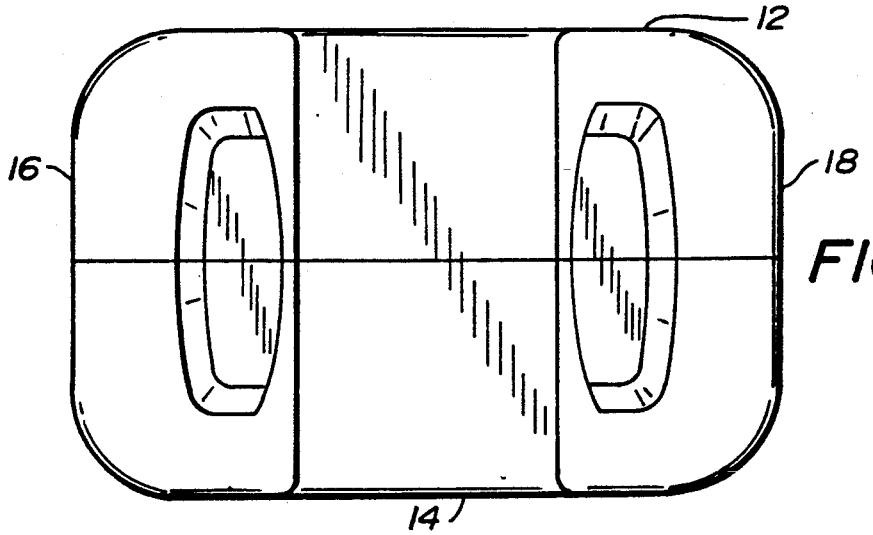
FIG. 3 is a bottom view taken in the direction of line 3—3 in FIG. 4.
Figure 4:
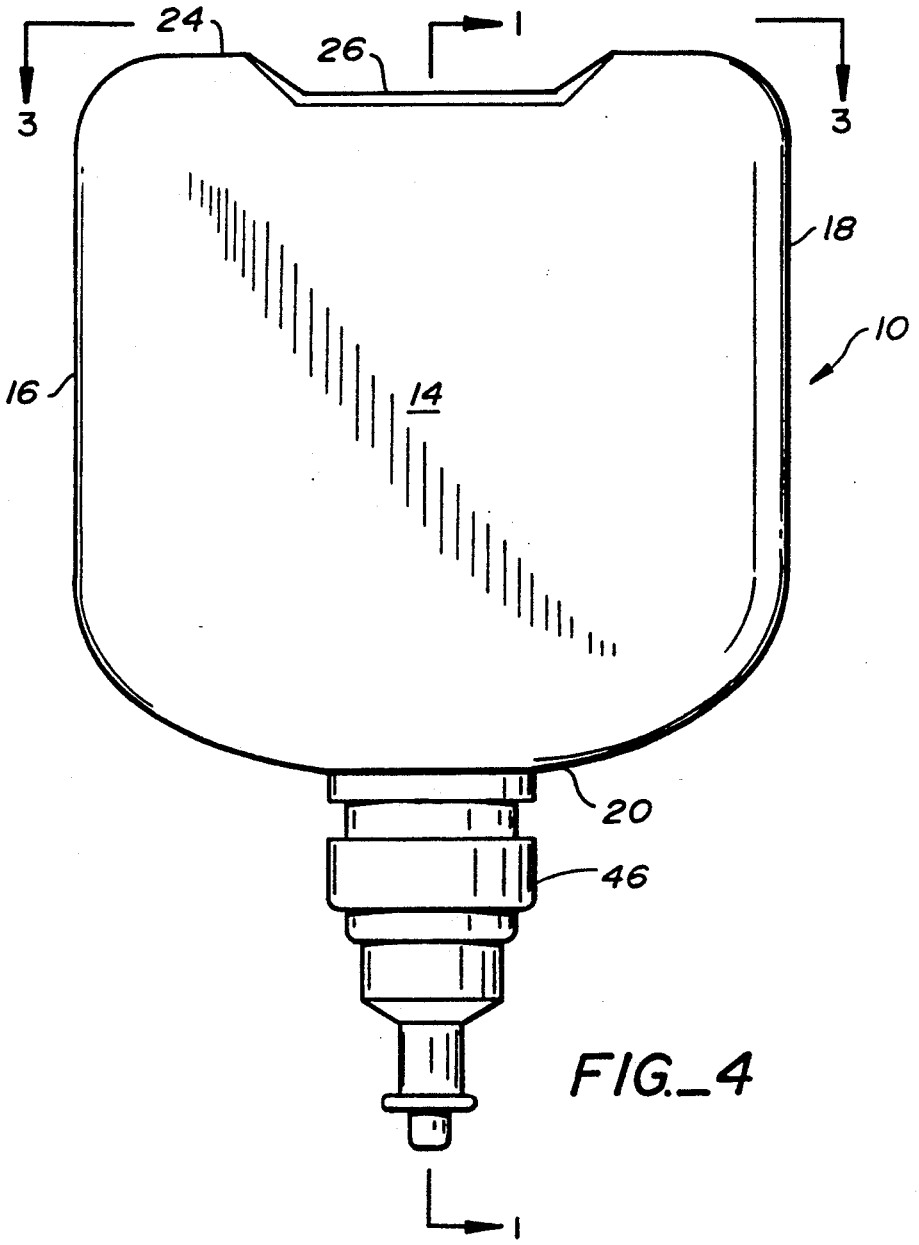
FIG. 4 is a front elevation view of the bottle having a pump attached to the bottle spout.

The flow path defined by spout 30 has a central axis A. When the bottle is in the uncollapsed condition illustrated in FIGS. 1, 3 and 4, bottom wall portion 22 defines a predetermined angle B relative to the central axis.

As previously stated, the bottle 10 is of unitary molded construction and formed of a suitable thermal plastic material. Manufacture of the bottle by the blow molding process creates a mold line M where the mold elements come together. At this point of juncture, the molded product has an increased wall thickness located along the mold line. Although in the present instance mold line M has a particular configuration, it is a characteristic of the blow mold process generally to find some increased wall thickness at the mold line. This is shown in highly exaggerated fashion in the cross-sectional depictions of bottle 10 where the mold line M extends along top wall 24. Likewise, the wall thicknesses of the auxiliary walls 16, 18 increase in the immediate vicinity of the auxiliary wall mold lines 32 of mold line M, thus serving to strengthen the auxiliary walls and resist collapse thereof during dispensing of the contents of the bottle 10 in a manner to be described in greater detail below.

Each of the auxiliary mold lines 32 is connected to a bottom wall mold line 34 extending along the bottom wall 20 from one of the auxiliary walls to the spout 30. Spout mold lines are formed on both sides of the spout in alignment both with one another and central axis A whereby the spout mold lines are disposed in a common plane generally bisecting the spout. One of these spout mold lines is shown in FIG. 1B and identified by reference numeral 36. The other spout mold line (not shown because of the cross-sectional nature of FIG. 1B) is, of course, identical. As may perhaps best be seen with reference to FIG. 1, the bottom wall mold lines 34 (only one of which is shown in FIG. 1) diverge obliquely from the auxiliary side wall mold lines 32 to which the bottom mold lines are connected and terminate at spout mold lines 36.

It has been found that with the aforedescribed construction the first primary wall 12 and the second primary wall 14 collapse different distances when the contents of the interior of bottle 10 are dispensed through the spout flow-path. More particularly, first primary wall 12 collapses a greater distance than the second primary wall 14. Further, during collapse of first primary wall 12 the bottom wall portion, due to the flexibility thereof, changes shape and cooperates with the collapsing primary walls in such a way as to encourage complete dispensing of the bottle contents. This feature may perhaps best be seen with reference to FIGS. 1, 1A, 1B, 2A and 2B.

Figure 1:
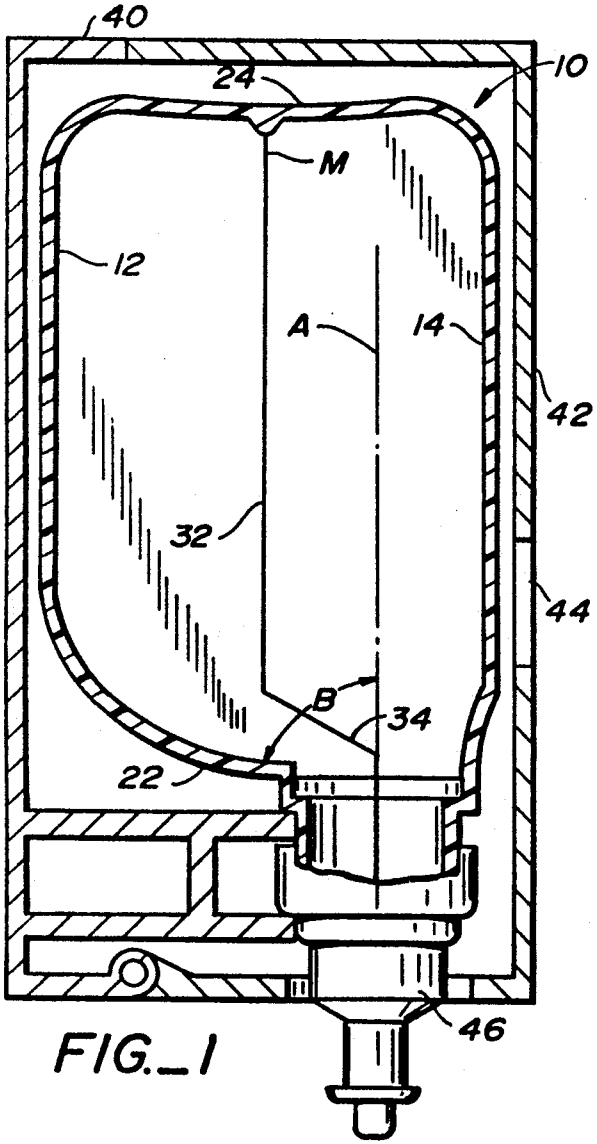
FIG. 1 is a cross-sectional, side elevation view illustrating a bottle constructed in accordance with the teachings of the present invention utilized in connection with a pump and disposed in a dispenser cabinet, and taken along the line 1—1 of FIG. 4.
Figure 2A:
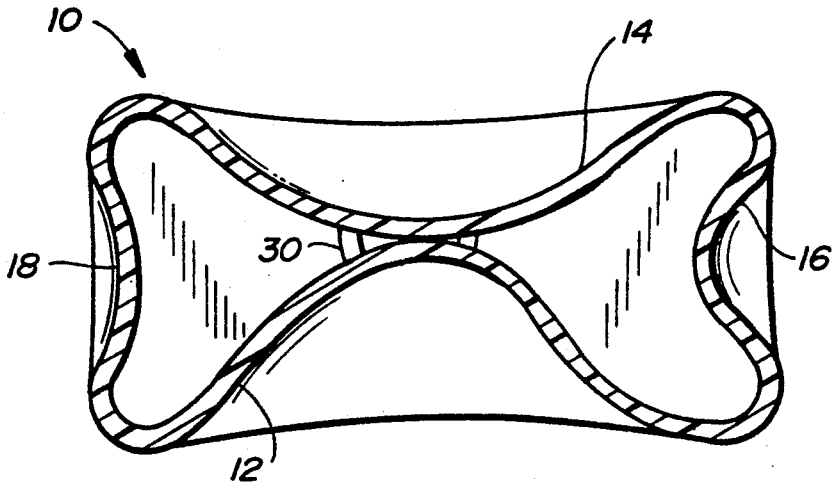
FIG. 2A is a cross-sectional view taken along the line 2A—2A in FIG. 1A.
Figure 2B:
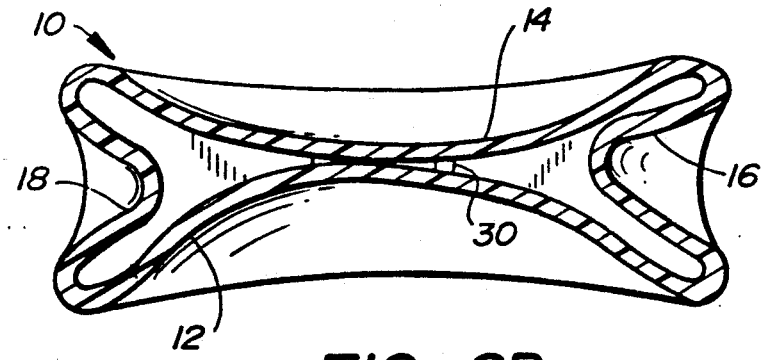
FIG. 2B is a cross-sectional view taken along the line 2B—2B in FIG. 1B.

FIG. 1 illustrates bottle 10 positioned in a suitable dispenser cabinet 40 having a cabinet front wall 42 with a view hole 44 formed therein. Also in FIG. 1, the bottle 10 has a pump 46 attached to the spout 30. The pump may be of any suitable construction. One suitable pump is that disclosed in co-pending U.S. patent application Ser. No.07/419,334, Tucker et al, filed Oct. 10, 1989.

As liquid, such as soap, lotion or the like, is dispensed from bottle 10 by actuation of pump 46, primary walls 12, 14 will begin to collapse, it being understood, of course, that pump 46 is of such a construction as to prevent a back flow of ambient air into the interior of bottle 10 during the dispensing process.

During dispensing, first primary wall 12 collapses inwardly a greater distance than does second primary wall 14 so that when the primary walls eventually meet it is at a location over the spout flow-path and generally along the plane defined by the spout mold line 36.

During such primary wall movement, bottom wall portion 22 gradually changes shape. That is, as can clearly be seen with reference to FIGS. 1A and 1B, the bottom wall portion assumes angles less than angle B during dispensing of the bottle contents and collapse of the first primary wall. As the bottle 10 reaches the near empty condition shown in FIG. 1B, bottom wall portion 22 overlies some of the spout thereby encouraging the downward flow of what is left of the bottle contents.

It is readily apparent from the foregoing description that virtually all of the collapse of the container occurs in the primary walls thereof, and particularly in the first primary wall 12. The auxiliary walls remain virtually unchanged as does the top wall 24. Since the second primary wall 14 collapses to a lesser degree than first primary wall 12, the second primary wall will remain relatively close to the wall 42 of the dispenser cabinet. Thus, one will readily be able to monitor depletion of the product held by the bottle when the bottle is formed of transparent or semi-transparent plastic material.

I claim:

1. A semi-rigid bottle of unitary molded construction and formed of thermoplastic material and collapsible from a first configuration to a second configuration during dispensing of the contents of said bottle, said bottle defining an interior and comprising, in combination:

first and second collapsible primary walls having a predetermined width;

first and second auxiliary walls spaced from one another and interconnecting said first and second primary walls, each of said auxiliary walls having a predetermined width less than the predetermined width of said primary walls;

a bottom wall interconnected to said primary and auxiliary walls, said bottom wall including a bottom wall portion;

a top wall connected to said primary and auxiliary walls and extending therebetween; and a spout defining a fluid flow-path leading from said interior and projecting outwardly from said bottom wall, said spout being located closer to said second primary wall than to said first primary wall and said bottom wall portion sloping downwardly from said first primary wall to said spout, said first primary wall and said second primary wall being collapsible toward one another, and said first primary wall collapsible a greater distance than the distance said second primary wall collapses during dispensing of contents from the interior of said bottle through said spout flow-path and said first and second primary walls engaging above said spout when said first and second primary walls are collapsed.

2. The bottle according to claim 1 wherein said bottom wall portion is flexible and changes shape from an initial configuration during dispensing of contents from said bottle interior through said spout flow path.

3. The bottle according to claim 2 wherein said spout flow path has a central axis, said bottom wall portion defining a predetermined angle relative to said central axis prior to change of shape of said bottom wall portion from said initial configuration, said bottom wall portion assuming an angle less than said predetermined angle relative to said central axis during dispensing of bottle contents and collapse of said first primary wall.

4. The bottle according to claim 1 wherein an auxiliary wall mold line extends along the length of each of said auxiliary walls from the top wall to said bottom wall, the wall thickness of said auxiliary walls increasing in the immediate vicinity of said auxiliary wall mold lines to strengthen said auxiliary walls and resist collapse thereof during dispensing of the contents of said bottle.

5. The bottle according to claim 4 wherein each of said auxiliary wall mold lines is connected to a bottom wall mold line extending along the bottom wall from one of auxiliary walls to said spout.

6. The bottle according to claim 5 wherein said bottom wall mold lines diverge obliquely from the auxiliary side wall mold lines to which said bottom wall mold lines are connected and terminate at spout mold lines, said spout mold lines disposed in a common plane generally bisecting said spout.

7. The bottle according to claim 6 wherein said first and second primary walls are in at least partial face-to-face engagement generally along said plane upon collapse of said bottle.

8. The bottle according to claim 7 wherein said bottom wall portion overlies at least some of said spout when said bottle is collapsed and in said second configuration.

9. A semi-rigid bottle formed of thermoplastic material and collapsible from a first configuration to a second configuration during dispensing of the contents of said bottle, said bottle comprising:

first and second primary walls;

first and second auxiliary walls interconnecting said primary walls;

a bottom wall;

a top wall, said primary, auxiliary, bottom and top walls defining an interior; and a spout projecting outwardly from said bottom wall and defining a fluid flow-path leading from said interior, said spout being offset on said bottom wall relative to said primary walls whereby said spout is positioned closer to said second primary wall than to said first primary wall when said bottle is uncollapsed and in said first configuration, said first and second primary walls being in at least partial face-to-face engagement over said spout when said bottle is collapsed and in said second configuration.

10. The bottle according to claim 9 wherein said auxiliary walls are reinforced along mold lines extending the length of said auxiliary walls.

11. The bottle according to claim 9 wherein said top wall and at least one of said primary walls are in at least partial face-to-face engagement when said bottle is collapsed and in said second configuration.

12. The bottle according to claim 9 wherein a portion of said bottom wall is positioned over said spout when said bottle is collapsed and in said second configuration.

* * * * *